United States Patent [19]

Wallick

[11] 3,971,909

[45] July 27, 1976

[54] MICROWAVE OVEN ANTENNA

[76] Inventor: William L. Wallick, 7414 Leescott Ave., Van Nuys, Calif. 91406

[22] Filed: Mar. 31, 1975

[21] Appl. No.: 563,646

[52] U.S. Cl. ..... 219/10.55 F; 219/10.55 B

[51] Int. Cl.[2] ..... H05B 9/06

[58] Field of Search ..... 219/10.55 F, 10.55 R, 219/10.55 E, 10.55 B

[56] References Cited

UNITED STATES PATENTS

| | | | |
|---|---|---|---|
| 3,320,396 | 5/1967 | Boehm | 219/10.55 B |
| 3,549,849 | 12/1970 | Boehm | 219/10.55 F |

*Primary Examiner*—Arthur T. Grimley

[57] ABSTRACT

The present invention is an improved antenna for radiating microwave energy in a microwave oven chamber. The improved antenna has a ground strap and shortening plate disposed a specified distance from the microwave energy feed point. The ground strap and shorting plate vectorally modify the phase angle of radiation such that the main beam of microwave energy is directed toward the cooking surface rather than toward the door and door seal. This eliminates hot spots on the door and provides for a better distribution of microwave energy within the oven chamber.

6 Claims, 4 Drawing Figures

Fig. 1
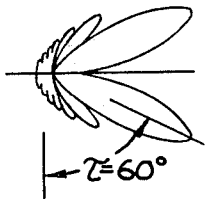
Fig. 2
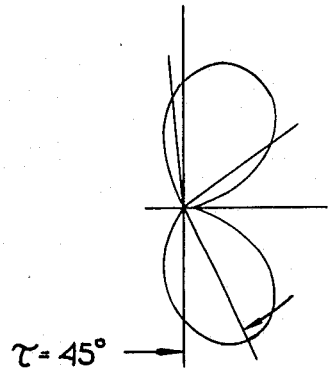
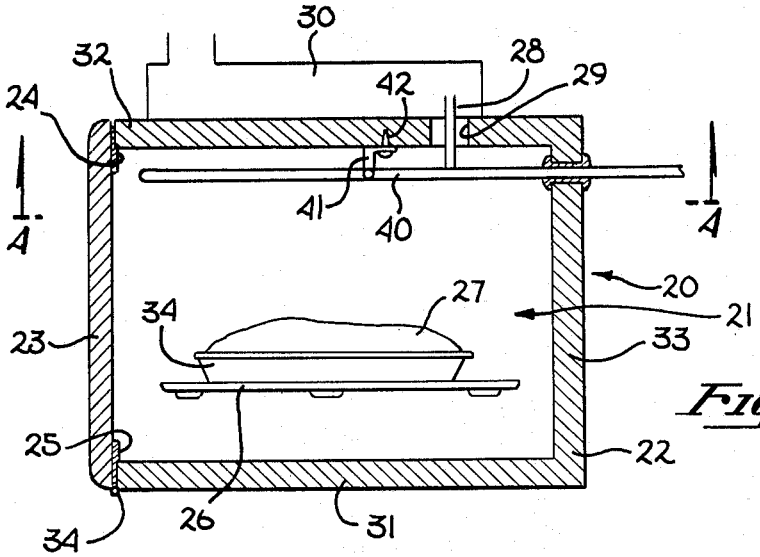
Fig. 3
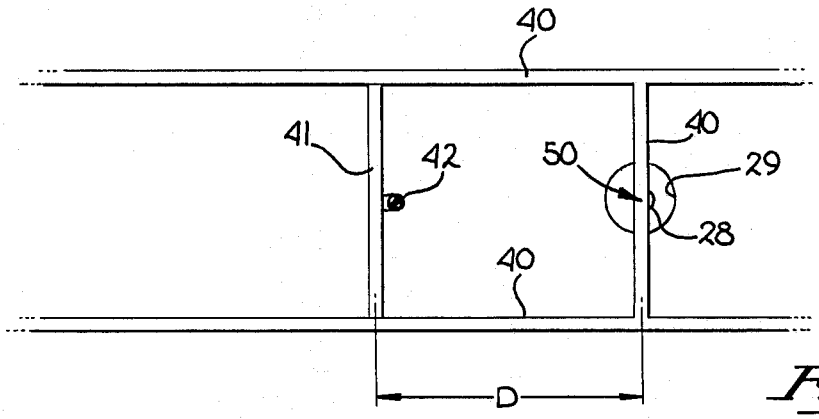
Fig. 4

MICROWAVE OVEN ANTENNA

BACKGROUND OF THE INVENTION

1. Field of the Invention

This invention relates generally to radiating antennas and more specifically to antennas used to radiate microwave energy in microwave ovens.

2. Prior Art

U.S. Letters Pat. No. 3,320,396 issued to Helmut Boehm and assigned to Bowmar/TIC discloses an invention relating to ovens which is capable of employing microwave energy, together with conventional low frequency heat energy, for cooking food. One feature of that invention is the single broil element which serves both as an antenna for radiating microwave energy in the oven chamber and also as a resistor type heater. A major problem with the invention is the pattern of radiation of microwave energy. In essence the broil element functions similar to a straight line antenna. The radiation pattern in straight line antennas is shown best in FIG. 1. The main beam of radiation is tilted an angle $\tau$ (the phase angle) from the vertical, as shown in FIG. 1. Since the broil element or antenna, is disposed either at the top or bottom of the oven cavity, substantial amounts of power are radiated towards the upper or lower portion of the oven door causing hot spots to form and/or high currents to flow across the oven door or door gasket.

This radiation pattern becomes critical in microwave oven production since the oven door must be effectively sealed to prevent leakage of microwave energy from the oven chamber. The most common method to prevent this leakage is to employ a door seal or gasket. In the prior art devices hot spots or high current flow existed at or near the door seal and damaged or rendered it unusable within a short period of time.

The present invention solves this problem by altering the pattern of radiation by modifying the angle of radiation such that the main beam of radiation is not directed toward the door or door seal. Another benefit of the present invention is that it creates a more uniform distribution of microwave energy within the oven cavity thereby increasing the efficiency of the cooking unit.

SUMMARY OF THE INVENTION

An improvement in the antenna portion of a microwave oven for altering the pattern of radiation and the phase angle of the microwave energy is disclosed. The invention includes a ground strap and shorting plate which modifies the effective length of the antenna. This reduction in effective length alters the phase angle such that the main beam of microwave energy is directed into the oven cavity rather than being directed towards the door and door seal.

It is an object of the present invention to provide an antenna element in a microwave oven that will radiate microwave energy efficiency within the oven cavity.

It is another object to provide a device to alter the phase angle of the main beam of radiation from the microwave antenna such that it will not be directed toward the door or door seal of the oven.

BRIEF DESCRIPTION OF THE DRAWINGS

FIG. 1 is a graph illustrating the phase angle and radiation pattern of the antenna of the prior art;

FIG. 2 is a graph illustrating the phase angle and radiation pattern of the antenna of the present invention;

FIG. 3 is a cross sectional view of the antenna of the present invention disposed within an oven cavity; and, FIG. 4 is a top view of a portion of the antenna, taken along line 4—4 of FIG. 3, illustrating the shorting plate and ground strap.

DETAILED DESCRIPTION OF THE PREFERRED EMBODIMENT

Referring now to FIG. 3, the oven here shown by way of example, to illustrate one embodiment of the invention includes structural means for defining an oven chamber 21 which is adapted to receive and surround an object 27 to be heated. The chamber is formed by six walls disposed in a box like configuration, these including upper and lower walls 32 and 31, a rear wall 33, two side walls (not visible), and a front wall constituted by a door 23 pivoted at 34 to swing between the opened and closed positions.

The object 27 to be heated may be, for example, an item of food. It is normally disposed in a non-metallic (e.g., paper, plastic, or glass) utensil 34 and inserted through the door 23 and placed, for support, on an open framework metal shelf 26 which is formed to permit passage of microwave and heat energy therethrough.

In accordance with the present invention, a metal element 40 (broil element) is disposed within the chamber 10 and is used as an antenna for radiating microwave energy. That element, in the preferred form serves as a resistive conductor, is used to thermally heat the oven, and is adapted to utilize current at a frequency much lower than microwave frequency.

It should be noted that the present invention is described as if the antenna element radiates both microwave energy and heat energy. In alternate embodiments it is within the purpose and scope of this invention to provide an antenna element which will only radiate microwave energy without being necessary to also generate heat energy.

The methods of creating and conducting microwave energy are well known in the prior art and are not discussed herein. Suffice it to state that a suitable microwave creating device (not shown) is coupled to a wave guide (not shown). The wave guide is coupled to a feed coax pin 28 which is coupled to antenna element 40. Thus, the generated microwave energy flows from the generating device through the wave guide and coax feed pin 28 and drives the antenna element 40. In the presently preferred form the antenna element 40 is formed from a rod like member and is illustrated in FIGS. 3 and 4.

The oven and antenna element as described to this point is similar to that disclosed in U.S. Letters Pat. No. 3,320,396. However, the broil element, or antenna, in that device or in any device where the field of the antenna is not confined to the immediate vicinity of the antenna or where no terminating impedance is coupled to the antenna, has the operating and generating characteristics of a single wire terminated antenna, (see FIG. 1). It can be assumed that in all single wire terminated antennas a uniform traveling wave current will flow towards the termination with a phase velocity substantially equal to the velocity of light. As can be seen, the main beam direction (angle $\tau$) is tilted in the direction of the traveling wave. This means that substantial amounts of power will be radiated along the antenna and towards the upper surface of the oven door 23 which will result in door surface heating and high current flow across the door or door gasket 24. This is very undesirable because the door gasket must be formed so as to prevent leakage of microwave energy from the oven cavity 21. Surface heating and high currents flowing across and through the door gasket 24 will cuase rapid deterioration or destruction of that door gasket and thereby enable microwave energy to leak from the oven.

The present invention comprises an improved antenna with a ground strap 42 and shorting plate 41, as shown generally in FIG. 3 and more specifically in FIG. 4. This modification of the antenna 40 essentially converts a portion of that antenna element 40 into the transmission line antenna. The shorting plate 41 and ground strap 42 electrically shorten the antenna length. Shortening the antenna length will modify the phase angle $\tau$ or the direction of radiation of the main beam of microwave energy.

The ground strap 42 essentially alters the antenna element such that only the portion between the ground strap 42 and the feed wax pin 29 radiates microwave energy. This modification alters the radiating patterns of the antenna and creates the desired effects heretofore described.

The phase angle $\tau$ is primarily a function of the phase velocity and antenna length in wave lengths. Altering the antenna length will modify the angle $\tau$. In the presently preferred embodiment it has been found that if the shorting plate 41 is located a distance D, (the distance D in the Bowmar BX-1 oven is 1.25 wavelengths) from the feed point 50, the phase angle will be reduced to approximately 45°, as shown in FIG. 2. Thus, the main beam of radiation of microwave energy is distributed more uniformly throughout the oven and is not directed toward the door and door seal.

It should be noted that actual microwave radiation patterns in any enclosure are more complex than the above discussion indicates, but in normal oven cavities this general theory is a very good indication of the actual radiation pattern within an oven cavity. The actual position of the shorting plate 41 was initially estimated by theoretical calculations, then precisely located by imperical methods. It should be noted that many factors influence the precise positioning of shorting plate 41 for optimum performance. Some of these factors are: the frequency of radiation; the phase velocity of radiation; the size of the oven cavity; and other physical characteristics of the antenna and oven cavity.

Thus, there has been described an improvement for an antenna in a microwave oven which provides two basic benefits: first, no concentrated band of microwave energy is directed toward the oven door 23 or door seal; and, second, a uniform radiation pattern of microwave energy is achieved throughout the oven cavity. In addition a better microwave radiation pattern is achieved by the addition of the shorting plate 41, which is disposed in a direction different from the main portions of the antenna element 40. This better distribution of microwave energy in the cavity increases efficiency of the oven by directing more of the available microwave power towards the cooking surface 26.

The present invention has been described as though used in a microwave oven in which the broil element serves as the antenna for radiating the microwave energy into the cavity, however, the invention could be employed wherever any antenna system is employed to radiate microwave energy into an oven cavity.

It should be noted that alternate method of construction is to eliminate the shorting plate 41 and couple a ground strap similar to ground strap 42 directly to the antenna 40 at the intersection points of the shorting plate and antenna 40. spacing the ground straps from the feed point can be adjusted for optimum power distribution as previously described.

However, while the preferred embodiment of the present invention has been described in detail herein, it will be understood by those skilled in the art that various changes in form and detail may be made therein without departing from the spirit and scope of the invention.

I claim:

1. An oven comprising a. means for defining an oven cavity;

b. element means disposed in said oven cavity;

c. means for supplying microwave energy to said element means causing said element means to radiate microwave energy therefrom;

d. ground means coupled to said element means for altering the phase angle of radiation of said radiated microwave energy.

2. The oven of claim 1 wherein said ground means comprises:

a. a shorting plate for coupled portions of said element means; and, b. a ground strap coupled to said shorting plate for grounding said element means, such that the phase angle of radiation of said radiated microwave energy is at least 45°.

3. The oven of claim 1 wherein said shorting plate is disposed 1.25 wavelengths from the feed coax point.

4. The oven of claim 1 wherein said shorting plate is disposed in a horizontal alignment different from said element means.

5. In a microwave oven which includes an oven cavity, a means for generating microwave energy, an element means disposed in said oven cavity, a means for supplying said microwave energy to said element means, said element means for radiating said microwave energy, the improvement wherein said element is grounded such that the phase angle of radiation is altered.

6. In a microwave oven which includes an oven cavity, a means for generating microwave energy, an element means disposed in said oven cavity, a means for supplying said microwave energy to said element means, said element means for radiating said microwave energy, the improvement wherein said element means is grounded such that the phase angle of radiation is increased to at least 45° thereby reducing hot spot formation and producing an efficient microwave distribution pattern within the oven cavity.

* * * * *